United States Patent [19]

Werner

[11] Patent Number: 4,723,920

[45] Date of Patent: Feb. 9, 1988

[54] ELECTRICAL CONNECTOR

[75] Inventor: Walter M. Werner, Downingtown, Pa.

[73] Assignee: AMP Incorporated, Harrisburg, Pa.

[21] Appl. No.: 937,773

[22] Filed: Dec. 4, 1986

[51] Int. Cl.[4] ..... H01R 4/44

[52] U.S. Cl. ..... 439/782; 439/783; 439/794; 439/815; 439/863

[58] Field of Search ..... 339/246, 247; 439/248 R, 248 S, 249 R, 249 A, 263 R, 273 R, 274

[56] References Cited

U.S. PATENT DOCUMENTS

| | | | |
|---|---|---|---|
| 1,466,735 | 9/1923 | Williams | 339/248 R |
| 3,065,452 | 11/1962 | Osborn | 339/274 |
| 3,462,543 | 8/1969 | Wahl et al. | 339/247 |
| 4,279,461 | 7/1981 | Bussen et al. | 339/247 |
| 4,600,264 | 7/1986 | Counsel | 339/249 R |
| 4,643,512 | 2/1987 | Prodel | 339/248 R |

*Primary Examiner*—Gil Weidenfeld
*Assistant Examiner*—Paula A. Austin
*Attorney, Agent, or Firm*—Allan B. Osborne

[57] ABSTRACT

An electrical connector for electrically connecting two conductors. More particularly the connector includes a C-shaped body member having parallel, inwardly facing channels along each side for receiving conductors therein and a pair of toggle blocks pivotally hinged together and each having outwardly facing channels along one side. The toggle blocks, having a combined width greater than the space between conductors positioned in the inwardly facing channels, compress the conductors therein when drawn into the body member.

6 Claims, 4 Drawing Figures

ELECTRICAL CONNECTOR

FIELD OF THE INVENTION

This invention relates to an electrical connector for electrically and mechanically connecting two conductors together. More particularly, the connector is of the type including a C-shaped member and toggle blocks which compress the conductors into parallel channels in the C-shaped member.

BACKGROUND OF THE INVENTION

Electrical connectors of the type having a C-shaped body member having converging channels and a complementary wedge member have been known from at least as early as Apr. 21, 1931 when U.S. Pat. No. 1,801,277 issued to W. G. Kelley on an application filed May 18, 1926. Subsequent thereto a large number of patents disclosing different and improved embodiments have issued, including more recently U.S. Pat. Nos. 4,415,222 and 4,600,264. In each of the disclosures, the basic Kelley concept was followed; i.e., two conductors are electrically and mechanically connected by being pressed into and against interior curved surfaces or channels provided in a C-shaped body member by a wedge being driven longitudinally into the body member between the conductors.

It is now proposed to provide an electrical connector wherein the conductors are forced into parallel channels in a C-shaped body member by a pair of toggle blocks being pressed into the body member in a direction normal to the longitudinal axis.

SUMMARY OF THE INVENTION

According to the invention, an electrical connector is provided which includes an elongated C-shaped body member having parallel, inwardly facing conductor-receiving channels along each longitudinal side, a pair of toggle blocks pivotally joined together which have a combined width greater than the space between conductors positioned in the channels and a bolt having a shaft extending through the C-shaped body member and attached to the toggle blocks so that upon pulling on the shaft, the toggle blocks are drawn in between the conductors to mechanically grip and electrically interconnect them.

BRIEF DESCRIPTION OF THE DRAWINGS

FIGS. 3 and 4 are perspective views of opposing sides of the electrical connector subsequent to electrically connecting the pair of conductors.

DESCRIPTION OF THE INVENTION

Figure 1:
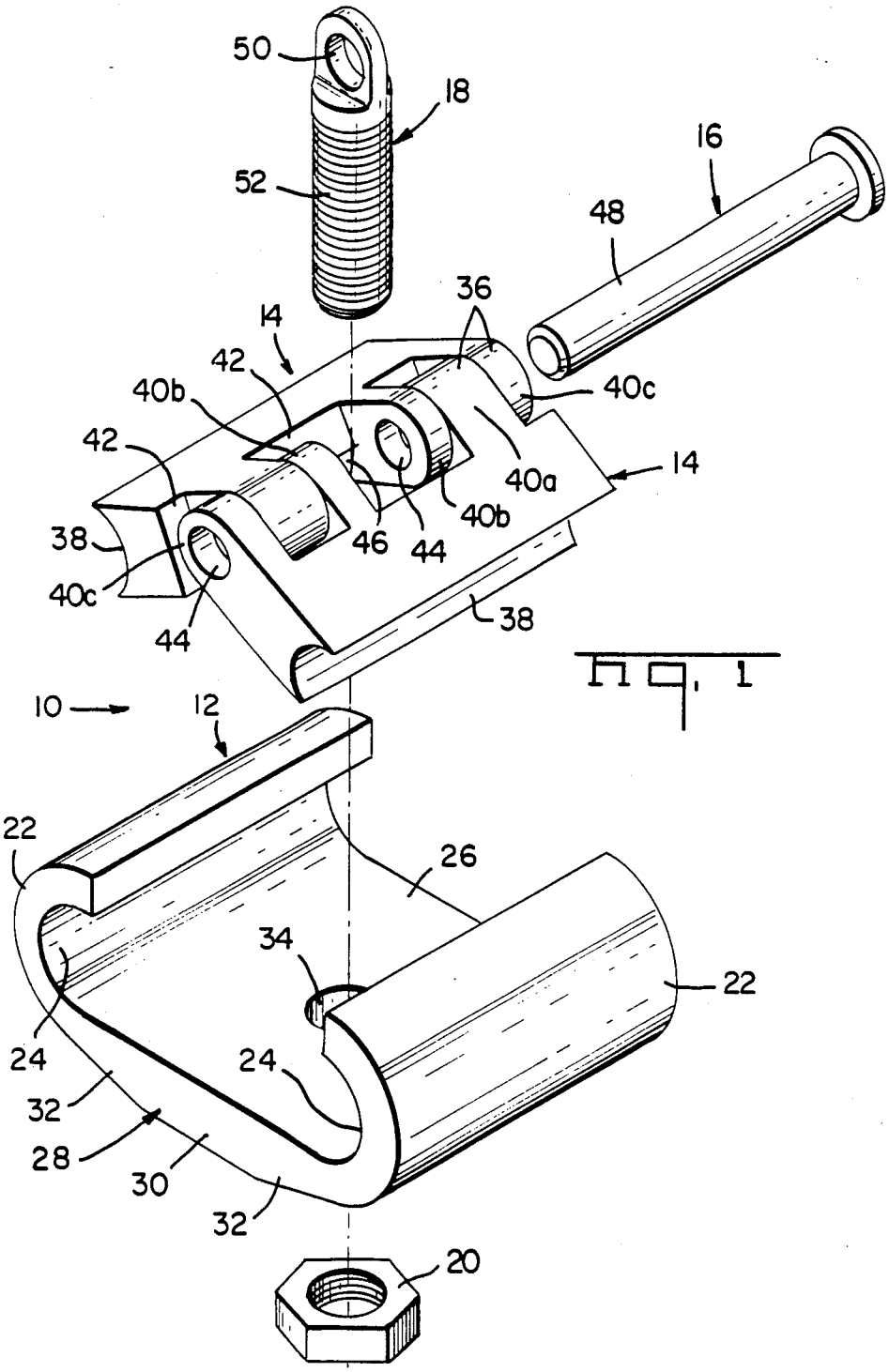
FIG. 1 is an exploded, perspective view of the electrical connector of the present invention showing the components thereof.

With reference to FIG. 1, the components of electrical connector 10 include C-shaped body member 12, a pair of toggle blocks 14, hinge pin 16, eye bolt 18 and nut 20. Preferrably, body member 12 and blocks 14 are made from 6061-T-6 aluminum. Pin 16 is made from stainless steel, and bolt 18 is made from steel.

C-shaped body member 12 is preferrably extruded with the longitudinal edges rolled over to define channel portions 22 and to provide parallel, interior curved channels 24.

Channels 24 face each other across surface 26 of wall 28 which joins portions 22. Channels 24 are dimensioned to conformably receive a range of conductor sizes; e.g., 795 26/7 ACSR to 636-37 AAC.

Wall 28 of body member 12 is thickest along a longitudinally extending middle portion 30 relative to parallel side portions 32 which are between and joins portion 30 and channel portions 22. As shown, the thickness of side portions 32 decreases outwardly from middle portion 30. The outward thinning of side portions 32 facilitates outward flexing of channel portions 22. Hole 34, extending through middle portion 30, receives bolt 18 therethrough.

With respect to toggle blocks 14, hinge sections 36 are provided on one longitudinal side and outwardly facing channels 38 are provided on the opposing sides. Blocks 14 are identical with channels 38 dimensioned to cooperate with channels 24 in body member 12.

Hinge sections 36 include three, spaced apart ears 40 projecting outwardly from side surface 42 with ears 40*a* being wider than ears 40*b* and 40*c*. Pin receiving holes 44 extend through each ear 40. Notches 46 in side surfaces 42 of blocks 14, adjacent ears 40*b*, cooperatively form a passage for bolt 20 when blocks 14 are joined together.

Toggle blocks 14 are sized so that their combined width is greater than the space between conductors positioned in respective channels 24 in body member 12. The excess width is such that upon pushing blocks 14 into that space, the conductors are compressed and mechanically gripped and, by reason of the conductivity of body member 12 and toggle blocks 14 are electrically interconnected.

Blocks 14 may be made by well known casting techniques or by extrusion coupled with machining.

Pin 16 includes shaft 48 which is dimensioned to be snugly received in holes 44 in ears 40 and hole 50 in eye bolt 18. Pin 16 may include an upset or head on one end of shaft 48 as shown but such is not necessary.

Eye bolt 18 includes the aforementioned hole 50 and threaded shaft 52 which receives nut 20.

Toggle blocks 14 are pivotally joined together by interfingering ears 40 on respective blocks 14 and sliding shaft 48 of pin 16 through aligned holes 44. Bolt 18 is positioned so that shaft 48 of pin 16 passes through hole 50 and threaded shaft 52 passes through notches 46 and extends outwardly from blocks 14.

Figure 2:
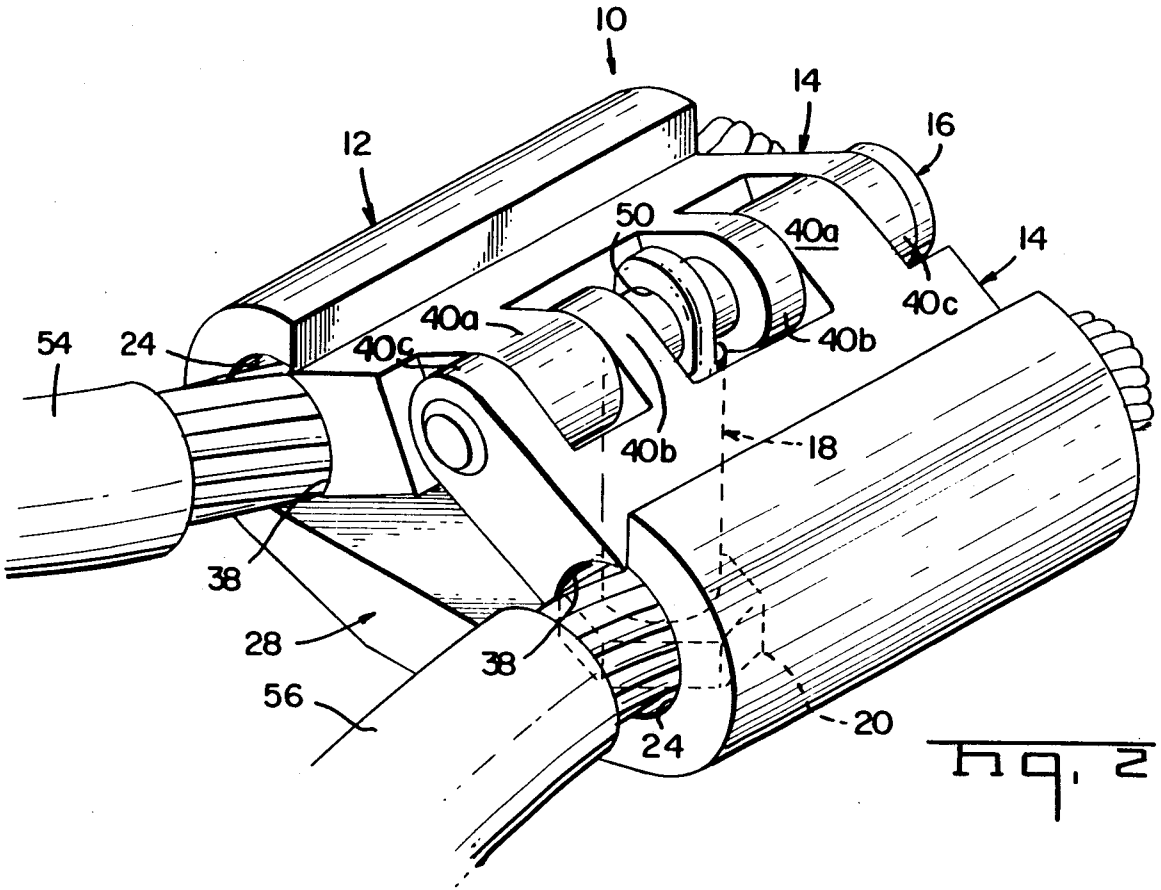
FIG. 2 is a perspective view of an assembled electrical connector preparatory to electrically connecting a pair of conductors.
Figure 1:
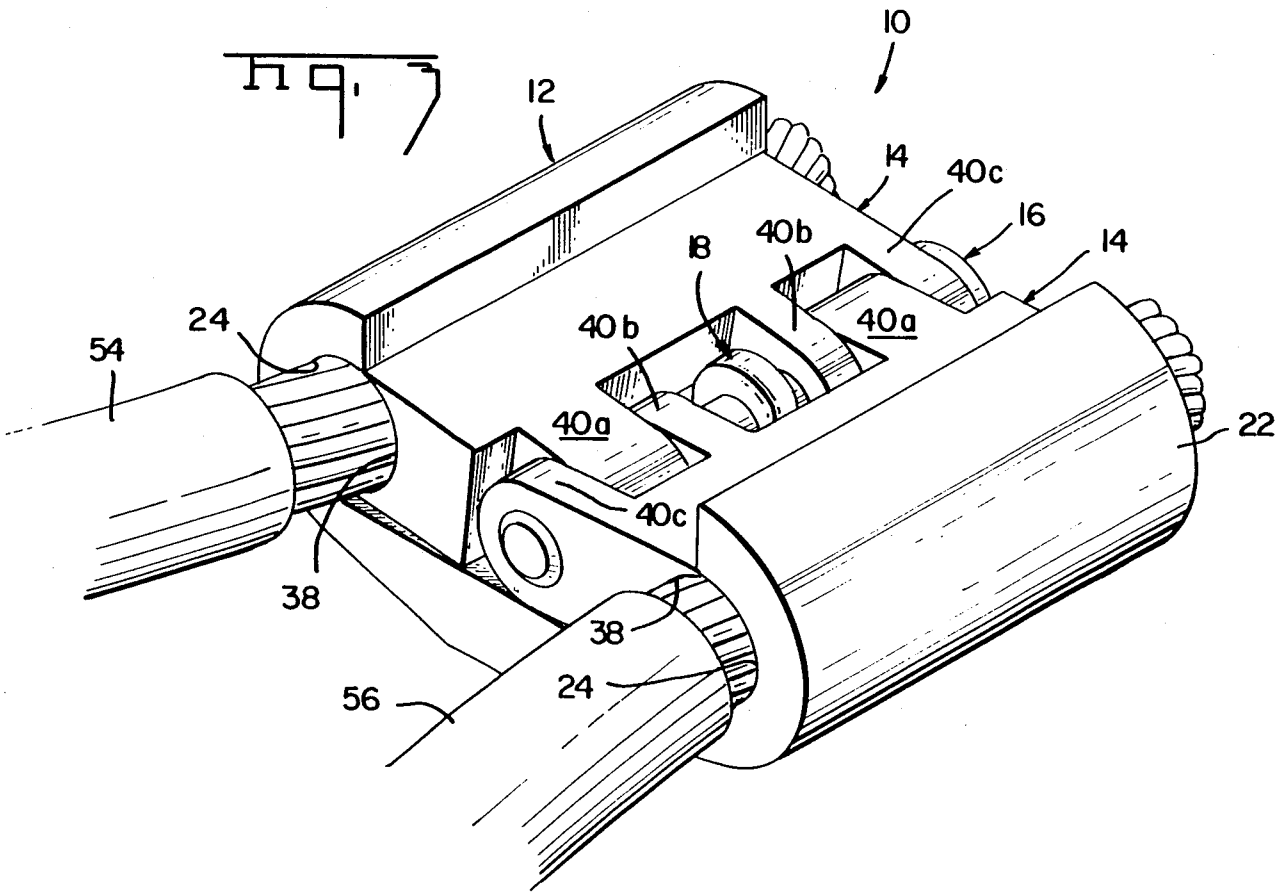

FIG. 2 illustrates a step in electrically connecting and mechanically gripping conductors 54, 56. Bared sections of conductors 54, 56 are placed in respective channels 24 of C-shaped body member 12 and toggle blocks 14, joined as described above, are positioned so that respective channels 38 abut against respective conductors 54, 56 and threaded shaft 52 of bolt 18 passes through hole 34 in wall 28 of member 12. As shown, blocks 14 angle out of member 12 due to their combined width being greater than the space between conductors 54, 56 in channels 24 of member 12. Nut 20 holds the assembly together by being threaded on shaft 52 until it engages wall 28.

The final step takes place by further rotating nut 20 to draw blocks 14 down to surface 26 of member 12. In so doing, blocks 14 push against conductors 54, 56 to compress them and accordingly are mechanically gripped and electrically interconnected. To the extent required by the dimensions of conductors 54, 56, channel portions 22 are resiliently spread apart which insures continued compressive forces on conductors 54, 56 even in the event of conductor creep, a well known phenomenon experienced by aluminum cables and wires.

As conductors 54, 56 are being compressed, the individual strands move and rub against each other, thereby scrubbing oxides and the like away to enhance current flow therebetween.

Figure 4:
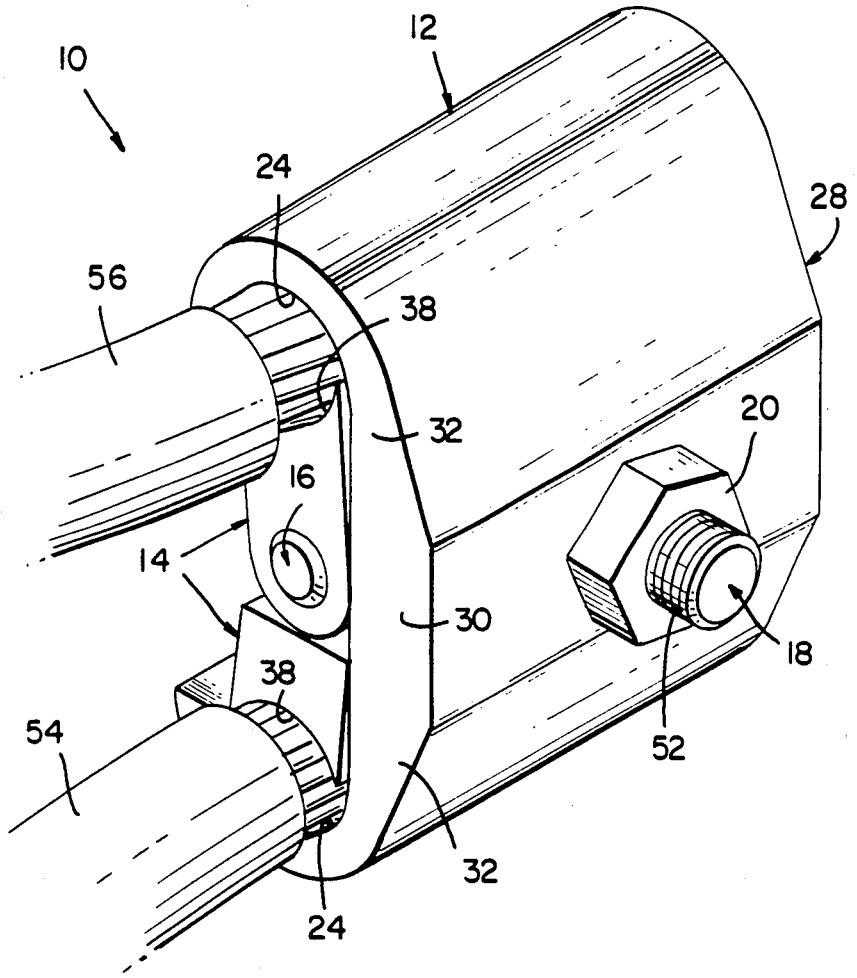

The connection is complete with blocks 14 flat or, as shown in FIGS. 3 and 4, slightly cammed over center which locks them in position. To break the connection, bolt 18 must be backed out to withdraw blocks 14 from body member 12. Connector 10 can be re-used within reason.

A feature of the present invention is that the connection is gas tight, which reduces the incident of corrosion.

As can be discerned, an electrical connector for electrically connecting two conductors has been disclosed. The connector includes a C-shaped body member having parallel and facing conductor-receiving channels and a pair of hinged toggle blocks which are received in the body member between the channels. The combined width of the toggle blocks exceed the space between conductors positioned in the channels so that they are compressed and mechanically gripped upon the toggle blocks being forced therebetween. The conductivity of the body member and toggle blocks provide an electrical interconnection between the conductors.

I claim:

1. An electrical connector for electrically connecting two electrical conductors, said connector comprising:

conductive, elongated, C-shaped body means having parallel, inwardly facing conductor-receiving channel means on each longitudinal side of and attached to intervening wall means and a hole extending through said wall means perpendicularly to the longitudinal axis of said body means;

a pair of conductive toggle block means pivotally joined together along a first side and each having outwardly facing, conductor-receiving channel means along an opposite second side, said toggle block means having a combined width greater than the space between conductors disposed in respective said channel means in said body means, said toggle block means adapted to be drawn into said body means with said outwardly facing channel means facing and cooperating with respective said inwardly facing channel means in said body means to grip and electrically interconnect conductors which may be disposed therebetween;

first means attached to said toggle block means and extending through said hole in said wall means and outwardly from said body means; and second means attachable to said first means extending outwardly from said body means for drawing said toggle block means in between said inwardly facing channel means in said body means.

2. The electrical connector of claim 1 wherein said intervening wall means includes a longitudinally extending middle portion and longitudinally extending side portions intermediate said middle portion and said channel means, said side portions thinning outwardly from said middle portion to said channel means whereby said channel means may be resiliently spread apart from each other.

3. The electrical connector of claim 1 wherein said toggle block means include spaced apart ears extending outwardly from said first side and having holes therethrough for receiving hinge means.

4. The electrical connector of claim 3 wherein said hinge means includes a pin received in said holes in said ears.

5. The electrical connector of claim 4 wherein said first means include a bolt having a threaded shaft extending through said hole and further having a hole for receiving said pin.

6. The electrical connector of claim 5 wherein said second means include a nut threadedly received on said shaft on said bolt.

* * * * *